US006260258B1

(12) United States Patent
Tokunaga et al.

(10) Patent No.: US 6,260,258 B1
(45) **Date of Patent: *Jul. 17, 2001**

(54) METHOD FOR MANUFACTURING VARISTOR

(75) Inventors: Hideaki Tokunaga, Chitose; Miho Higashitani; Yasuo Wakahata, both of Katano, all of (JP)

(73) Assignee: Matsushita Electric Industrial Co., Ltd. (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/180,418

(22) PCT Filed: May 27, 1997

(86) PCT No.: PCT/JP97/01787

§ 371 Date: Nov. 10, 1998

§ 102(e) Date: Nov. 10, 1998

(87) PCT Pub. No.: WO97/47017

PCT Pub. Date: Dec. 11, 1997

(30) Foreign Application Priority Data

Jun. 3, 1996 (JP) ..... 8-139876
May 12, 1997 (JP) ..... 9-120603

(51) Int. Cl.[7] ..... H01C 7/02

(52) U.S. Cl. ..... 29/612; 29/614; 338/21; 338/308

(58) Field of Search ..... 29/610, 610.1, 29/612, 621; 340/719, 718, 716, 765; 338/20, 21, 325, 332

(56) References Cited

U.S. PATENT DOCUMENTS 4,290,041 * 9/1981 Utsumi ..... 338/21
4,700,169 * 10/1987 Tanno ..... 338/21
5,070,326 * 12/1991 Yoshimoto et al. ..... 340/719

FOREIGN PATENT DOCUMENTS 62-122103 6/1987 (JP) .
3-173402 7/1991 (JP) .
5-36501 2/1993 (JP) .

* cited by examiner

*Primary Examiner*—Lee Young
*Assistant Examiner*—Sean Smith
(74) *Attorney, Agent, or Firm*—Parkhurst & Wendel, L.L.P.

(57) ABSTRACT

A method for manufacturing varistor by which a varistor having a high plating resistance and a high moisture resistance is manufactured by selectively forming a compact high-resistance layer having a uniform thickness on the surface of a varistor element. In the method, the varistor element (1) is first formed by alternately laminating ceramic sheets (1*a*) mainly of a zinc oxide and internal electrodes (2) upon one another, and then, Ag electrode paste which becomes external electrodes (3) is applied to both end faces of the element (1). Then, after the element (1) is sintered through heat treatment, the element (1) is buried in $SiO_2$ or a mixture (5) containing $SiO_2$ and the element (1) is heat-treated for 5–10 minutes at 600–950° C. in the air or in an oxygen atmosphere.

14 Claims, 2 Drawing Sheets

METHOD FOR MANUFACTURING VARISTOR

TECHNICAL FIELD

The present invention relates to a method for manufacturing a varistor.

BACKGROUND ART

Conventionally, after forming electrodes on the surface of a varistor element mainly composed of ZnO, a high resistance layer made of glass was formed on the surface of the varistor element, and the surface of the electrodes was plated to obtain a varistor.

However, the high resistance layer made of glass could not be formed selectively on the surface of the varistor element alone, and it was hard to form in a uniform thickness. Accordingly, when plating, plating flow occurred to cause shorting, or moisture invaded into the varistor element to deteriorate the electric characteristic of the varistor.

DISCLOSURE OF THE INVENTION

It is hence an object of the invention to present a method for manufacturing a varistor having a high plating resistance and a high moisture resistance by selectively forming a compact high-resistance layer with a uniform thickness on the surface of a varistor element.

To achieve the object, a method for manufacturing a varistor of the invention comprises a first step of obtaining a varistor element by forming a material mainly composed of ZnO, a second step of forming at least two first electrodes at a specific spacing on the surface of the varistor element, a third step of applying a first heat treatment to the varistor element, and a fourth step of applying a second heat treatment after disposing Si powder on the surface of the varistor element.

According to this method, since a dense high-resistance layer having a uniform thickness is formed, a varistor excellent in a moisture resistance and a plating resistance can be obtained.

BEST MODE FOR CARRYING OUT THE INVENTION

Figure 1:
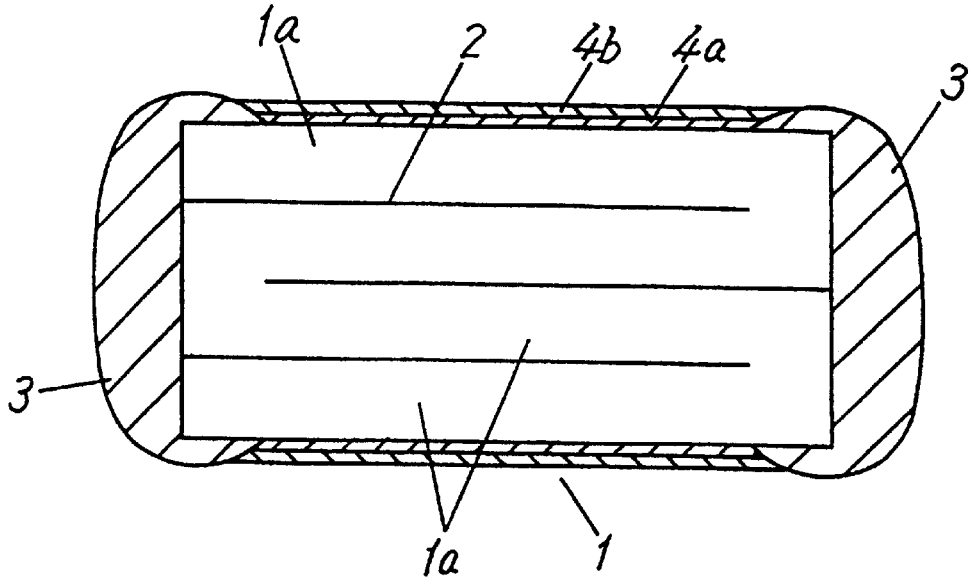
FIG. 1 is a sectional view of a varistor in an embodiment of the invention.
Figure 2:
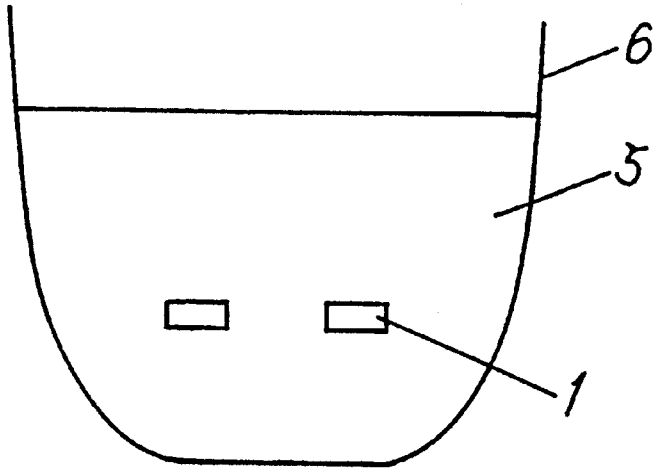
FIG. 2 is an explanatory diagram of burning process in an embodiment of the invention.

In FIG. 1, plural inner electrodes 2 mainly composed of Ag are provided inside a varistor element 1. These inner electrodes 2 are alternately drawn out to both ends of the varistor element 1, and are electrically connected to outer electrodes 3 individually at the both ends. Ceramic sheets 1*a* laminated between inner electrodes 2 and at the outer side thereof are mainly composed of ZnO, and contain also $Bi_2O_3$, $Co_2O_3$, $MnO_2$, $Sb_2O_3$, and others as a subsidiary component. Reference numerals 4*a*, 4*b* are high-resistance layers formed when burned together with $SiO_2$ or a mixture containing $SiO_2$ as a principal component. FIG. 2 shows a state of heat treatment that the element 1 is heated in an alumina crucible 6 together with $SiO_2$ powder or a powder mixture containing $SiO_2$ as a principal component and at least one selected from the group of $Fe_2O_3$, $Sb_2O_3$, $TiO_2$, $Al_2O_3$, $Bi_2O_3$, $B_2O_3$, PbO, $Na_2CO_3$, $K_2CO_3$, and AgO as a subsidiary component (hereinafter called $SiO_2$ or mixture 5), when forming the high-resistance layers 4*a*, 4*b* on the surface of the varistor element 1.

A method for manufacturing a varistor of this embodiment is described below.

First, ceramic sheets 1*a* were obtained by mixing a material mainly composed of zinc oxide, a plasticizer, a binder, and others, grinding the mixture, forming the ground mixture into slurry, and forming the slurry into sheets. Then, these ceramic sheets 1*a* and inner electrodes 2 mainly composed of silver were alternately laminated, and the laminated body was cut into a predetermined size so that the inner electrodes 2 may be drawn out to the corresponding end surfaces alternately in order to obtain a varistor element 1. Next, the varistor element 1 was heated for a time of 5 minutes to 10 hours at a temperature of 100 to 300° C. to remove the plasticizer from the varistor element 1, and the surface of the varistor element 1 was chamfered.

Consequently, both end surfaces of the varistor element 1 were coated with an Ag electrode paste which became to outer electrodes 3, and the varistor element 1 was sintered by heat treatment for a time of 5 minutes to 10 hours at a temperature of 600 to 950° C.

And then, the varistor element 1 was buried in $SiO_2$ or mixture 5 and heated for a time of 5 minutes to 10 hours at a temperature of 600 to 950° C. in air or oxygen atmosphere, by using an alumina crucible 6 as shown in FIG. 2. By this heat treatment, ZnO which is a principal component of the varistor element 1 and $SiO_2$ react each other, and a high-resistance layer 4*a* mainly composed of $Zn_2SiO_4$ is formed on the surface of the varistor element 1. Incidentally, when $Bi_2O_3$ is added as a subsidiary component to the varistor element 1, $Bi_2O_3$ reacts with ZnO and $SiO_2$ to promote formation of $Zn_2SiO_4$, and also a high-resistance layer 4*b* mainly composed of $Bi_4(SiO_4)_3$ is formed between the high-resistance layer 4*a* and the surface of the varistor element 1. Since they react and are formed in the portions not expressing the electric characteristic of varistor, they have no adverse effects on the electric characteristic of varistor, so that an excellent varistor extremely superior in a plating resistance and a moisture resistance is obtained.

What is important herein is that, as shown in FIG. 2, the entire outer surface of individual varistor elements 1 should be buried so as to contact with $SiO_2$ or mixture 5. For this purpose, $SiO_2$ or mixture 5 is spread in the alumina crucible 6 in a specified thickness, and a specified number of varistor elements 1 are arranged thereon so as not to contact with each other. And then, $SiO_2$ or mixture 5 is put over in this state, and heat treatment is applied. Depending on the composition of mixture 5, however, mixture 5 may contact on the outer electrode 3 due to anchor effect, and in such a case it is necessary to keep conduction by removing mixture 5 on the outer electrode 3 by grinding or the like. If the anchor effect is too large to be removed by grinding or the like, or if the high-resistance layers 4*a*, 4*b* on the surface of the varistor element 1 are removed by grinding, a further outer electrode past may be applied and baked on the outer electrode 3 to form the outer electrodes to keep conduction.

Afterwards, electrolytic Ni plating and electrolytic solder plating were applied on the surface of the outer electrodes 3, and a varistor was obtained. The plating thickness of the obtained varistor was 2 $\mu$m in Ni plating and 2 $\mu$m in solder plating.

Results of plating resistance of the varistors are shown in Table 1.

As shown in Table 1, when the varistor element 1 not including high resistance-layers 4*a*, 4*b* is plated, the surface of the varistor element 1 other than the outer electrodes 3 is also plated. When $Fe_2O_3$, $Sb_2O_3$, $TiO_2$, $Al_2O_3$, $Bi_2O_3$, $B_2O_3$ or glass frit which is a subsidiary component is added to $SiO_2$, instead of $SiO_2$ alone, flow of plating is further decreased, and more uniform high-resistance layers 4*a*, 4*b* seem to be formed.

Table 2 shows the voltage ratio ($V_{1mA}/V_{10\ \mu A}$) of the varistors after burning in $SiO_2$ or mixture 5.

As shown in Table 2, the varistor including the mixture of $SiO_2$ with PbO, $Na_2CO_3$, $K_2CO_3$, MgO, $CaCO_3$ and $Ag_2O$ is smaller in the voltage ratio than the varistor including $SiO_2$ powder alone, and is more excellent in the nonlinearity of low current region. This is considered because the addition of such additives contributes to stabilization of the grain boundary area that seems to determine the nonlinearity.

In the varistor of the embodiment, while resistance of the surface is heightened, it is also enhanced in density, and therefore it simultaneously brings about the effect of prevention of invasion of plating solution at the time of plating.

the stability of electrical characteristics and ceramic characteristics of the varistor, better results are obtained when sintering reaction and high-resistance layer forming reaction of the varistor element 1 are done separately. If, however, the sintering reaction and high-resistance layer forming reaction of the varistor element 1 are done simultaneously, the high resistance layers 4*a*, 4*b* can be formed. At this time, whether the varistor element 1 is formed before or after forming the outer electrode 3, it is important that the outer electrode 3 should be formed so as to conduct with outside during use.

(5) In this embodiment, $SiO_2$ and the additives in mixture 5 are added in oxide form, but as far as becoming an oxide in the reaction temperature range (600 to 950° C.), not limited to oxide, but any compound may be used.

(6) In mixture 5, by defining the principal component $SiO_2$ at 80 wt. % or more, high-resistance layers 4*a*, 4*b* can be formed easily.

(7) By adding a compound of Fe, Sb, Ti, Al, Bi or B, or glass frit to mixture 5 mainly composed of $SiO_2$, a tendency

TABLE 1

| | Prior art | | Embodiment | | | | | | |
|---|---|---|---|---|---|---|---|---|---|
| Mixed powder | No coating | $SiO_2$ | $SiO_2$:$Fe_2O_3$ = 95:5 (wt %) | $SiO_2$:$Sb_2O_3$ = 95:5 (wt %) | $SiO_2$:$TiO_2$ = 95:5 (wt %) | $SiO_2$:$Al_2O_3$ = 95:5 (wt %) | $SiO_2$:$Bi_2O_3$ = 95:5 (wt %) | $SiO_2$:$B_2O_3$ = 99:1 (wt %) | $SiO_2$:glass frit = 95:5 (wt %) |
| Ratio of flow of plating | 50/50 | 2/50 | 0/50 | 0/50 | 0/50 | 0/50 | 0/50 | 0/50 | 0/50 |

Ratio = Number of samples causing flow of plating/total number of samples

TABLE 2

| Mixed powder | $SiO_2$ | $SiO_2$:PbO = 95:5 (wt %) | $SiO_2$:$Na_2CO_3$ = 95:5 (wt %) | $SiO_2$:$K_2CO_3$ = 95:5 (wt %) | $SiO_2$:MgO = 95:5 (wt %) | $SiO_2$:$CaCO_3$ = 95:5 (wt %) | $SiO_2$:$Ag_2O$ = 95:5 (wt %) |
|---|---|---|---|---|---|---|---|
| $V_{1mA}/V_{10\mu A}$ | 1.23 | 1.11 | 1.1 | 1.12 | 1.12 | 1.13 | 1.12 |

Important points in this invention are described below.

(1) When burying a varistor element 1 in $SiO_2$ or mixture 5, although high-resistance layers 4*a*, 4*b* are formed only by burying as shown in FIG. 2, considering the reactivity, it is more effective to strengthen the adhesion between $SiO_2$ or mixture 5 with a varistor element 1 by applying pressure by putting a weight or the like on mixture 5 in FIG. 2.

(2) In heat treatment for forming high-resistance layers 4*a*, 4*b*, by rotating by putting a specified number of varistor elements 1 and $SiO_2$ or mixture 5 into a sleeve such as a cylindrical piece, more uniform high-resistance layers 4*a*, 4*b* can be formed. Besides, by heating while rotating, as compared with the case of using the crucible 6, not only high-resistance layers 4*a*, 4*b* can be formed by a small amount of $SiO_2$ or mixture 5, but also temperature fluctuations of the varistor element 1 are small, so that a varistor having small fluctuations of varistor characteristics such as a varistor voltage can be obtained.

(3) After immersing a varistor element 1 in a liquid containing at least one organic metal compound selected from the group consisting of organic metal compounds of Si, Pb, Fe, Sb, Ti, Al, B, Bi, Ag, alkaline metal, and alkaline earth metal, by burying the varistor element 1 in $SiO_2$ or mixture 5 and heating, dense high-resistance layers 4*a*, 4*b* having much uniform thickness can be formed.

(4) In the embodiment, high-resistance layers 4*a*, 4*b* are formed by heating in $SiO_2$ or mixture 5, after heating and sintering the varistor element 1. This is because, considering of higher resistance is noted, and by adding a compound of Ag, Pb, alkaline metal or alkaline earth metal, enhancement of nonlinearity of varistor characteristic is observed.

(8) In the embodiment, only one of oxides of Fe, Sb, Ti, Al, Bi, B, Ag, Pb, alkaline metal or alkaline earth metal, or glass frit is added to mixture 5 mainly composed of $SiO_2$, but if two or more compounds thereof are added, the same effects are obtained.

(9) The glass frit composed of 60 wt % of $Bi_2O_3$, 20 wt % of $B_2O_3$, 10 wt % of $SiO_2$, and 10 wt % of $Ag_2O$ is used in the embodiment, and if glass frit containing B is used, it is easy to form high-resistance layers 4*a*, 4*b*, since the softening point is low.

(10) If attempted to form uniform high-resistance layers 4*a*, 4*b*, it is preferred to make uniform the particle size of $SiO_2$ or mixture 5 as far as possible.

(11) The embodiment relates to the laminate type varistor, but same effects are obtained in a varistor in disk shape or other shape.

INDUSTRIAL APPLICABILITY

According to the invention, high-resistance layers of Zn—Si—O system or Bi—Si—O system mainly composed of $Zn_2SiO_4$ or $Bi_4(SiO_4)_3$ are formed in the surface of a varistor element not covered with electrodes. Since these high-resistance layers are dense and uniform in thickness, they prevent invasion of undesired moisture or the like from invading into the varistor element, so that the varistor characteristics may not deteriorate. Moreover, it is also effective to prevent occurrence of defect such as short circuit due to plating of other portions than the electrode area of the surface of the varistor element at the time of plating. Still more, in the case of a laminate varistor, the size can be reduced, since the thickness of the reactive layer can be made thinner than before.

What is claimed is:

1. A method for manufacturing a varistor, comprising:

a first step of obtaining a varistor element by forming a material comprised of ZnO, a second step of forming at least two first electrodes at a specific spacing on a surface of the varistor element, a third step of applying a first heat treatment to the varistor element having said at least two first electrodes to sinter the varistor element, and a fourth step of applying a second heat treatment at a temperature of 600° C. to 950° C. after placing Si compound powder on a surface of the sintered varistor element to form a high-resistance layer comprising $Zn_2SiO_4$ on the surface of the varistor element.

2. The method for manufacturing a varistor of claim 1, wherein the fourth step is to heat while rotating the varistor element and the Si compound powder.

3. The method for manufacturing a varistor of claim 1, wherein the Si powder in the fourth step comprises a mixture of a principal component of Si compound and a subsidiary component selected from the group consisting of Pb compound, Fe compound, Sb compound, Ti compound, Al compound, B compound, Bi compound, Ag compound, alkaline metal compound, alkaline earth metal compound, and glass frit.

4. The method for manufacturing a varistor of claim 3, wherein the heat treatment in the fourth step is performed while rotating the varistor element and the mixture.

5. The method for manufacturing a varistor of claim 1, wherein a second electrode is formed on each of the at least two first electrodes after the fourth step.

6. The method for manufacturing a varistor of claim 1, wherein the varistor element is immersed in a liquid containing at least one organic metal compound selected from the group consisting of organic metal compounds of Si, Pb, Fe, Sb, Ti, Al, B, Bi, Ag, alkaline metal, and alkaline earth metal, after the third step.

7. A method for manufacturing a varistor, comprising:

a first step of obtaining a varistor element by forming a material comprised of ZnO, a second step of forming at least two first electrodes at a specific spacing on a surface of the varistor element, and a third step of applying a heat treatment at a temperature of 600° C. to 950° C. after placing a powder of a mixture of a principal component of Si compound and a subsidiary component selected from the group consisting of Pb compound, Fe compound, Sb compound, Ti compound, Al compound, alkaline metal compound, alkaline earth metal compound, and glass frit on a surface of the varistor element having said at least two first electrodes to sinter the varistor element and to form a high-resistance layer comprising $Zn_2SiO_4$ on the surface of the varistor element.

8. The method for manufacturing a varistor of claim 7, wherein a second electrode is formed on each of the at least two first electrodes after the third step.

9. The method for manufacturing a varistor of claim 7, wherein the varistor element is immersed in a liquid containing at least one organic metal compound selected from the group consisting of organic metal compounds of Si, Pb, Fe, Sb, Ti, Al, B, Bi, Ag, alkaline metal, and alkaline earth metal, after the second step.

10. The method for manufacturing a varistor of claim 7, wherein the heat treatment in the third step is performed while rotating the varistor element and the mixture.

11. A method for manufacturing a varistor, comprising:

a first step of obtaining a varistor element by forming a material comprised of ZnO, a second step of applying a heat treatment at a temperature of 600° C. to 950° C. after placing a powder of a mixture of a principal component of Si compound and a subsidiary component selected from the group consisting of Pb compound, Fe compound, Sb compound, Ti compound, Al compound, B compound, Bi compound, Ag compound, alkaline metal compound, alkaline earth metal compound, and glass frit on a surface of the varistor element to sinter the varistor element and to form a high-resistance layer comprising $Zn_2SiO_4$ on the surface of the varistor element, and a third step of forming at least two electrodes on a surface of the varistor element.

12. The method for manufacturing a varistor of claim 11, wherein the varistor element is heated between the first step and second step.

13. The method for manufacturing a varistor of claim 11, wherein the varistor element is immersed in a liquid containing at least one metal compound selected from the group consisting of organic metal compounds of Si, Pb, Fe, Sb, Ti, Al, B, Bi, Ag, alkaline metal, and alkaline earth metal, before the second step.

14. The method for manufacturing a varistor of claim 11, wherein the heat treatment in the second step is performed while rotating the varistor element and the mixture.

* * * * *

UNITED STATES PATENT AND TRADEMARK OFFICE

CERTIFICATE OF CORRECTION

PATENT NO. : 6,260,258 B1
DATED : July 17, 2001
INVENTOR(S) : Hideaki Tokunaka et al.

It is certified that error appears in the above-identified patent and that said Letters Patent is hereby corrected as shown below:

Column 1,
Line 37, after "Si" insert -- compound --;
Line 67, change "AgO" to -- $Ag_2O$ --.

Signed and Sealed this

Twenty-eighth Day of January, 2003

JAMES E. ROGAN
*Director of the United States Patent and Trademark Office*